US010294955B2

(12) United States Patent
Learn et al.

(10) Patent No.: US 10,294,955 B2
(45) Date of Patent: May 21, 2019

(54) FAN APPARATUS

(71) Applicant: GENERAL ELECTRIC COMPANY, Schenectady, NY (US)

(72) Inventors: Leroy Eugene Learn, Erie, PA (US); Joel Terence Montione, Erie, PA (US)

(73) Assignee: GE Global Sourcing LLC, Norwalk, CT (US)

( * ) Notice: Subject to any disclaimer, the term of this patent is extended or adjusted under 35 U.S.C. 154(b) by 431 days.

(21) Appl. No.: 15/132,520

(22) Filed: Apr. 19, 2016

(65) Prior Publication Data

US 2017/0298952 A1 Oct. 19, 2017

(51) Int. Cl.

| | |
|---|---|
| ***F04D 29/02*** | (2006.01) |
| ***F04D 29/32*** | (2006.01) |
| ***F04D 29/38*** | (2006.01) |
| ***F04D 29/58*** | (2006.01) |
| ***F04D 29/64*** | (2006.01) |

(52) U.S. Cl.

CPC ..... *F04D 29/329* (2013.01); *F04D 29/023* (2013.01); *F04D 29/384* (2013.01); *F04D 29/582* (2013.01); *F04D 29/644* (2013.01)

(58) Field of Classification Search

None

See application file for complete search history.

(56) References Cited

U.S. PATENT DOCUMENTS 773,548 A * 11/1904 Cross ..... F04D 29/329 416/220 A
874,805 A * 12/1907 Stine ..... F04D 29/329 416/214 R
3,260,312 A * 7/1966 Elmer ..... B64C 11/346 416/144
5,069,601 A * 12/1991 Shawcross ..... F04D 25/088 416/204 R
5,354,177 A * 10/1994 Chang ..... F04D 29/34 416/219 A
5,927,945 A * 7/1999 Chen ..... F01D 5/3069 416/210 R
6,048,173 A * 4/2000 Chen ..... F04D 25/088 416/206
6,062,820 A * 5/2000 Wang ..... F04D 25/088 416/204 R
6,095,753 A * 8/2000 Hsu ..... F04D 29/34 416/204 R
6,139,277 A * 10/2000 Lopatinsky ..... F01D 5/3015 416/220 A (Continued)

*Primary Examiner* — Jason D Shanske
*Assistant Examiner* — Theodore C Ribadeneyra
(74) *Attorney, Agent, or Firm* — McCoy Russell LLP

(57) ABSTRACT

A fan apparatus (e.g., for a vehicle radiator) includes a hub and plural fan blades. The hub has an annular hub body with an outer peripheral wall, an interior, and a central axis. The hub body defines plural blade retention apertures spaced apart from one another around the hub body and extending radially outward from the interior through to the outer peripheral wall. The fan apparatus also includes plural fan blades respectively removably disposed in the plural blade retention apertures. The fan blades and the blade retention apertures are complimentary in shape for the fan blades to be retained by the hub solely by centrifugal force when the hub is rotated for operation of the fan apparatus.

20 Claims, 10 Drawing Sheets

(56) References Cited

U.S. PATENT DOCUMENTS

| | | | | |
|---|---|---|---|---|
| 6,378,824 | B1 * | 4/2002 | Tseng | F04D 25/088 248/220.21 |
| 6,390,777 | B1 * | 5/2002 | Kerr, Jr. | F04D 25/088 416/204 R |
| 6,699,014 | B1 * | 3/2004 | Lam | F04D 25/088 416/210 R |
| 2005/0287005 | A1 * | 12/2005 | Gruber | F04D 25/0613 416/244 R |
| 2007/0009363 | A1 * | 1/2007 | King | F04D 25/088 416/210 R |
| 2010/0054942 | A1 * | 3/2010 | Beckford | F01D 5/282 416/193 A |
| 2010/0278637 | A1 * | 11/2010 | Oleson | F04D 25/088 415/121.3 |
| 2013/0336790 | A1 * | 12/2013 | Wortman | F01D 5/141 416/170 R |
| 2015/0000636 | A1 * | 1/2015 | Stockbridge | B60H 1/3222 123/350 |
| 2015/0167692 | A1 * | 6/2015 | Kobayashi | F04D 29/541 415/208.1 |
| 2015/0300364 | A1 * | 10/2015 | Lin | F04D 25/088 416/221 |
| 2017/0030367 | A1 * | 2/2017 | Cahill | F04D 29/329 |
| 2017/0218973 | A1 * | 8/2017 | Bishop | F02K 3/06 |
| 2017/0321561 | A1 * | 11/2017 | Kobayashi | F04D 29/36 |
| 2017/0350414 | A1 * | 12/2017 | Wang | F04D 25/088 |

* cited by examiner

FAN APPARATUS

TECHNICAL FIELD

Embodiments of the subject matter disclosed herein relate to fan assemblies, such as a fan assembly for a vehicle radiator or other cooling system.

BACKGROUND

Vehicles and other powered units may include cooling systems with radiators, namely, a cooling fluid (e.g., liquid)-to-air heat exchanger for transferring thermal energy from the cooling fluid to ambient (external to the powered unit). Such cooling systems may be used, for example, for cooling vehicle engines, power electronics, or the like.

In some instances, a radiator fan assembly is operably disposed in association with a radiator, to generate a flow of air across and/or through the radiator, to promote a desired degree of cooling. The radiator fan assembly may include a central hub, plural fan blades attached to the hub, and a drive mechanism (e.g., electrical motor, or gear mechanism coupled to a mechanical engine output) for rotating the hub and thereby the fan blades. The fan blades may be welded to the hub. In such a case, if one of the blades wholly or partially detaches from the hub due to some sort of fault mechanism (e.g., repeated mechanical strain over time), the entirety of the fan assembly must be removed for servicing. Due to the need for removal of the old blade remnants and re-welding on of a new blade, this can be expensive and time consuming, resulting in significant system downtime.

BRIEF DESCRIPTION

In an embodiment, a fan apparatus includes a hub and plural fan blades. The hub has an annular hub body with an outer peripheral wall, an interior, and a central axis. The hub body defines plural blade retention apertures spaced apart from one another around the hub body and extending radially outward from the interior through to the outer peripheral wall. The fan apparatus also includes plural fan blades respectively removably disposed in the plural blade retention apertures. The fan blades and the blade retention apertures are complimentary in shape for the fan blades to be retained by the hub at least solely by centrifugal force when the hub is rotated for operation of the fan apparatus. ("At least solely" means the fan blades would be retained even if only mechanically engaged to the hub—by way of the complementary shape of the apertures and blades—when the hub is rotated, due to centrifugal force; it does not preclude the use of additional fasteners such as spot welding or other welding, adhesives, shims, screws, bolts, etc.)

In another embodiment, a fan apparatus includes a hub having an annular hub body with an outer peripheral wall, an interior, a central axis, a top surface, and an opposing bottom surface. The hub body defines plural blade retention slots spaced apart from one another around the hub body and extending radially outward from the interior through to the outer peripheral wall. The plural blade retention slots are only partially enclosed by the hub body such that the top surface of the hub body defines respective top openings of the slots. Additionally, the plural fan blades have respective base portions attached to respective blade portions, and the base portions are respectively removably disposed in the plural blade retention slots with the blade portions extending radially outwards from the outer peripheral wall. The base portions are tapered and/or flared for engagement with complementary features of the hub body, for the fan blades to be retained by the hub at least solely by centrifugal force when the hub is rotated for operation of the fan apparatus. In this embodiment, an end cap is fastened to the hub body and configured to at least partially cover the top openings of the slots to prevent the fan blades from being longitudinally removed from the slots in the direction of the central axis.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Embodiments of the inventive subject matter relate to a fan apparatus, such as a fan apparatus for use with a vehicle radiator. In an embodiment, the fan apparatus includes a hub and plural fan blades. The hub has an annular hub body with an outer peripheral wall, an interior, and a central axis. The hub body defines plural blade retention apertures spaced apart from one another around the hub body and extending radially outward from the interior through to the outer peripheral wall. The fan apparatus also includes plural fan blades respectively removably disposed in the plural blade retention apertures. The fan blades and the blade retention apertures are complimentary in shape for the fan blades to be retained by the hub at least solely by centrifugal force when the hub is rotated. In this manner, since the fan blades are retained in apertures defined by the hub body, if one of the blades wholly or partially breaks off, the blade can be replaced without removing the entirety of the fan assembly, resulting in reduced vehicle/system downtime. For example, a broken fan blade may be replaced by removing only the hub body, or by removing only an end cap attached to the hub body. This eliminates the need to move an entire heavy fan assembly, and it eliminates the need to have a welder present to make extensive repairs, because replacement blades can be operably coupled to the hub by insertion into the retention apertures, rather than being welded to the outside.

The term "annular" as used herein includes, but is not limited to, ring-shaped, circular, rounded, oval, polygonal, and the like; unless otherwise specified, an annular hub body is any body that can be provided with fan blades and rotated about an axis for generating an air flow. In specific embodiments, an annual hub body is cylindrical, and may have a hollow interior. The term "retention aperture" refers to a partially enclosed space defined by the hub body (e.g., formed in the hub body) and configured to receive the base portion of a fan blade. "Slots" are a sub-category or type of retention aperture that are open across the annular top surface of the annular hub body, such that a fan blade can be longitudinally removed from the slot within the hub body in a direction of the central axis of the hub body. "Holes" are another sub-category or type of retention aperture that are at least partially enclosed across the annular top surface of the annular hub body, such that a fan blade can only be removed from the hub body in a radial direction. "Centrifugal force" refers to the outward force directed away from a central axis of rotation that acts on all objects when viewed in a rotating frame of reference.

Figure 1:
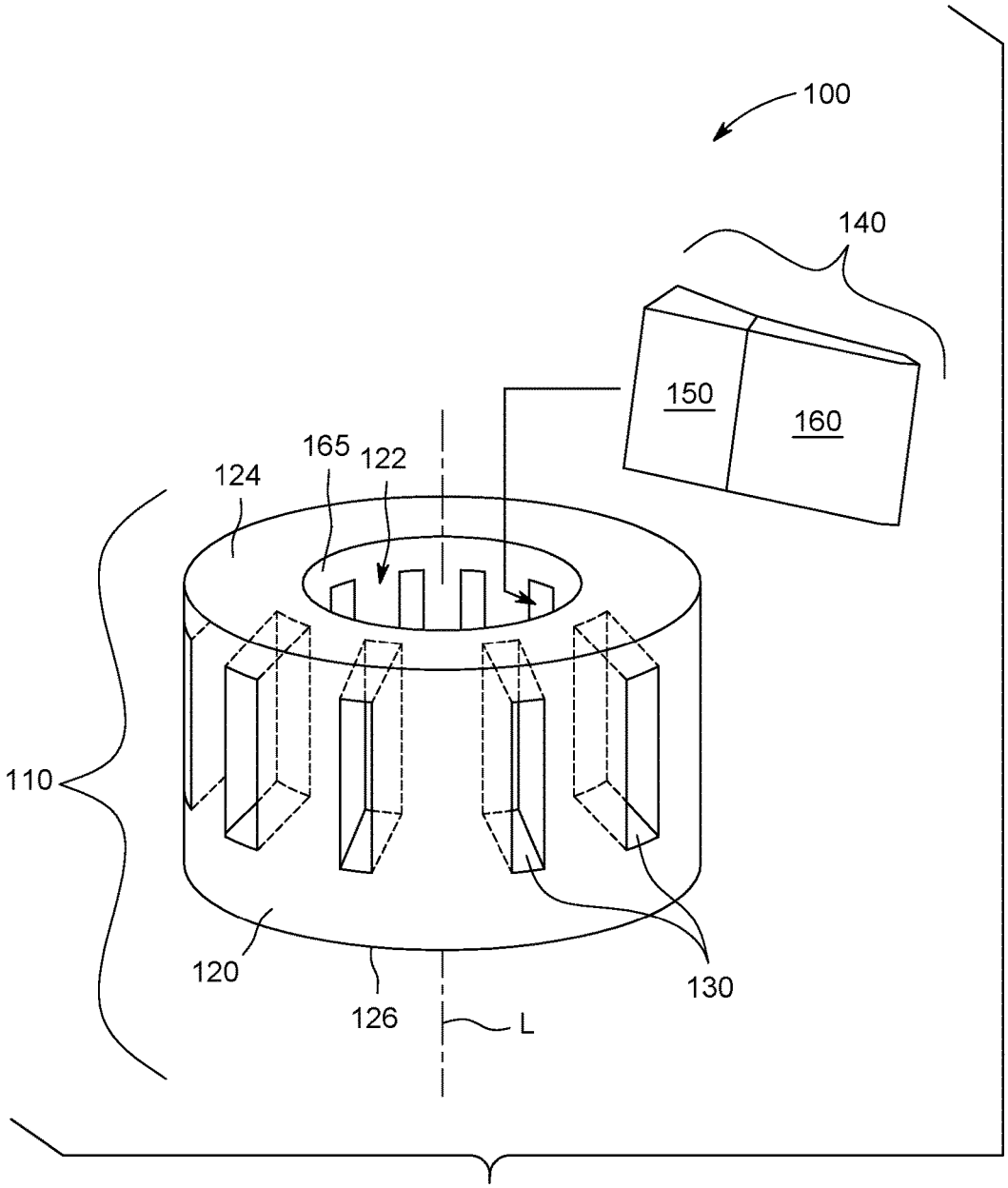
FIG. 1 is a perspective view of an embodiment of a fan apparatus.
Figure 2A:
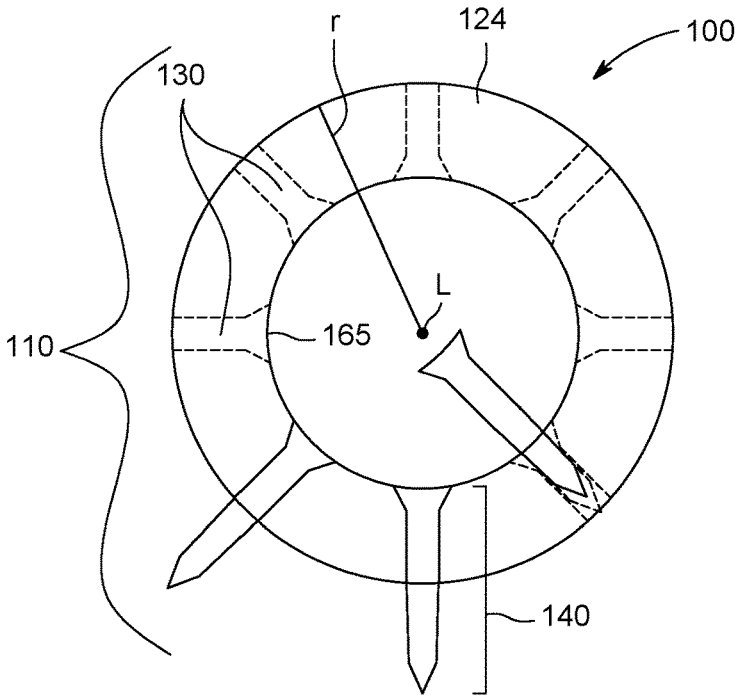
FIG. 2A is a top plan view of an embodiment of a fan apparatus.

FIG. 1 shows an embodiment of a fan apparatus 100 that includes a hub body 110 having an outer peripheral wall 120, an interior 122, a central axis "L," which may be an axis of rotation of the hub body, and a radius or radial direction "r" (see FIG. 2A). (The radius is a direction extending perpendicularly outwards from the central axis to the outer peripheral wall, i.e., a line normal to the central axis, and does not necessarily mean the hub body is circular in cross section.) The hub body 110 defines plural blade retention apertures 130 spaced apart from one another around the hub body and extending radially outward from the interior through to the outer peripheral wall. (For example, the blade retention apertures may be formed in the hub body by machining, casting, additive manufacturing, etc.) In this embodiment, the blade retention apertures are holes that extend from respective openings in the interior through to openings in the outer peripheral wall; the holes are enclosed in the direction of a top surface 124 of the hub body and in the direction of a bottom surface 126 of the hub body. The fan apparatus further includes plural fan blades 140. (Only one such fan blade is shown in FIG. 1, however, the apparatus would further include plural additional, similar fan blades, one for each aperture.) Each of the fan blades includes a respective base portion 150 attached to a respective blade portion 160. The blade portions are shaped to move air when the hub body is rotated about its central axis. The base portions are complementary in shape to the blade retention apertures for the fan blades to be retained by the hub body, in a radial outwards direction and when the hub body is rotated about the central axis, even if no other fastener is used to radially hold the fan blade in place. For example, in one embodiment (as further discussed below), the base portions are tapered for retention by the hub. In other embodiments (also as further discussed below), the base portions are flared for retention by the hub. Thus, in an assembled state, the base portions of the fan blades are disposed in the plural blade retention apertures (e.g., holes or slots) with the blade portions extending radially outwards from the outer peripheral wall, as shown in other figures.

The hub body interior may be hollow, and the hub body may further include an inner peripheral wall 165 spaced radially concentrically inwards from the outer peripheral wall 120 and defining the hollow interior. ("Hollow" refers to a lack of material of the hub body, e.g., that extends through to an opening at the top surface of the hub body; it does not preclude the presence of other elements within that space that are not part of the hub body, such as motor parts for turning the hub body.) The top surface of hub body interconnects the inner peripheral wall and the outer peripheral wall. In such an embodiment, the blade retention apertures 130 extend from and through the inner peripheral wall 165 (i.e., they open up to the hollow interior with respective inner opening edges defined by the inner peripheral wall) to and through the outer peripheral wall 120 (i.e., they open up to a side exterior of the hub body with respective outer opening edges defined by the outer peripheral wall).

Figure 2B:
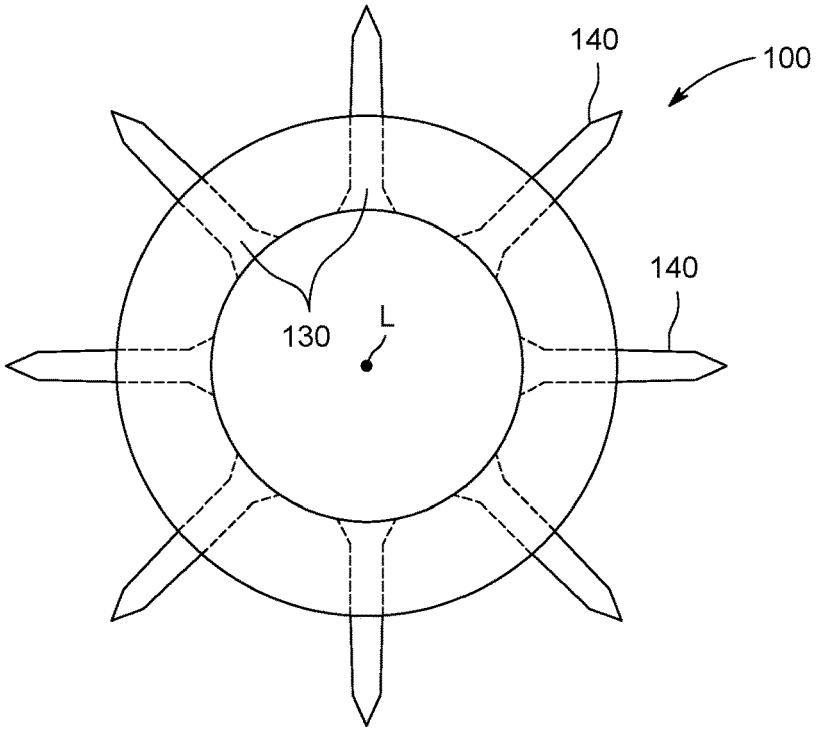
FIG. 2B is a top plan view of an embodiment of a fan apparatus complete with fan blades.

As indicated by the arrow in FIG. 1 and as also shown in FIG. 2A, for coupling one of the fan blades 140 to the hub body 110, the fan blade can be maneuvered into the hollow interior of the hub body. With the blade portion pointing outwards, the fan blade is then moved radially outwards through the blade retention aperture 130 (i.e., the blade portion is inserted first), until the base portion 150 abuts and/or is fully disposed in the blade retention aperture and the blade portion lies extended out past the outer peripheral wall. This process is repeated with additional fan blades until fan blades are retained in each and every retention aperture defined within the hub body, as shown in FIG. 2B.

The blade retention apertures and the fan blade bases are complementary in shape to one another for the fan blades to be retained by the hub at least solely by centrifugal force when the hub is rotated around the central axis "L" for operation of the fan assembly. For example, the blade retention apertures may be wholly or partially tapered, with the base portions of the fan blades being at least partially correspondingly wholly or partially tapered. In a wholly tapered configuration, as shown in FIG. 1 for example, the interior of the aperture as extending between the outer peripheral wall and the inner peripheral wall may be frusto-conical in shape or frusto-pyramidal in shape (e.g., truncated square or rectangular pyramid), with the opening of the aperture on the side of the outer peripheral wall having a smaller area than the opening of the aperture on the side of the inner peripheral wall. The base portions of the fan blades are complementary in shape, and thereby tapered such that the base portions occupy the apertures when the fan blades are fully inserted therein. In a partially tapered configuration, as shown in FIGS. 2A and 2B, the radially outermost portions of the blade retention apertures are not tapered or angled (e.g., as extending a distance inwards from the outer peripheral wall, the cross-sectional area of the aperture, perpendicular to the long axis of the aperture, is uniform), whereas the innermost portions are tapered or angled (e.g., as extending between the inwards-most end of the portion of the aperture having the uniform cross-sectional area through to the inner peripheral wall, the aperture widens out, for example, in the shape of a frusto-cone or frusto-pyramid). The base portions of the fan blades are complementary in shape, and thereby partially tapered (at the end of the fan blade that is distal from the end tip/edge of the blade portion) such that the base portions occupy the apertures when the fan blades are fully inserted therein. Regardless of the particular complementary shape with which the blade retention apertures and the fan blade base portions are provided, the blade retention apertures are dimensioned to allow the fan blade portions of the fan blades to pass therethrough when the fan blades are inserted from the interior of the hub body, and to prevent the fan blade base portions, when fully set in the apertures, from moving radially outwards when the hub body is rotated about the central axis.

Although the hole-type blade retention apertures are shown in FIG. 1 as being completely enclosed in top and bottom directions, the apertures could be partly open in either the top direction or the bottom direction. For example, the hub body could be provided with threaded through-bores extending down from the top surface of the hub body through to the interiors of the apertures, which are configured to receive set screws to help maintain the fan blades in place against movement in a radially inwards direction. For this purpose, the fan blade base portions could be provided with upwards-facing detents for receiving the tips of such set screws, which would be aligned with the threaded through-bores when the base portions were fully inserted into the apertures, to facilitate engagement between the set screws and fan blades.

Figure 3A:
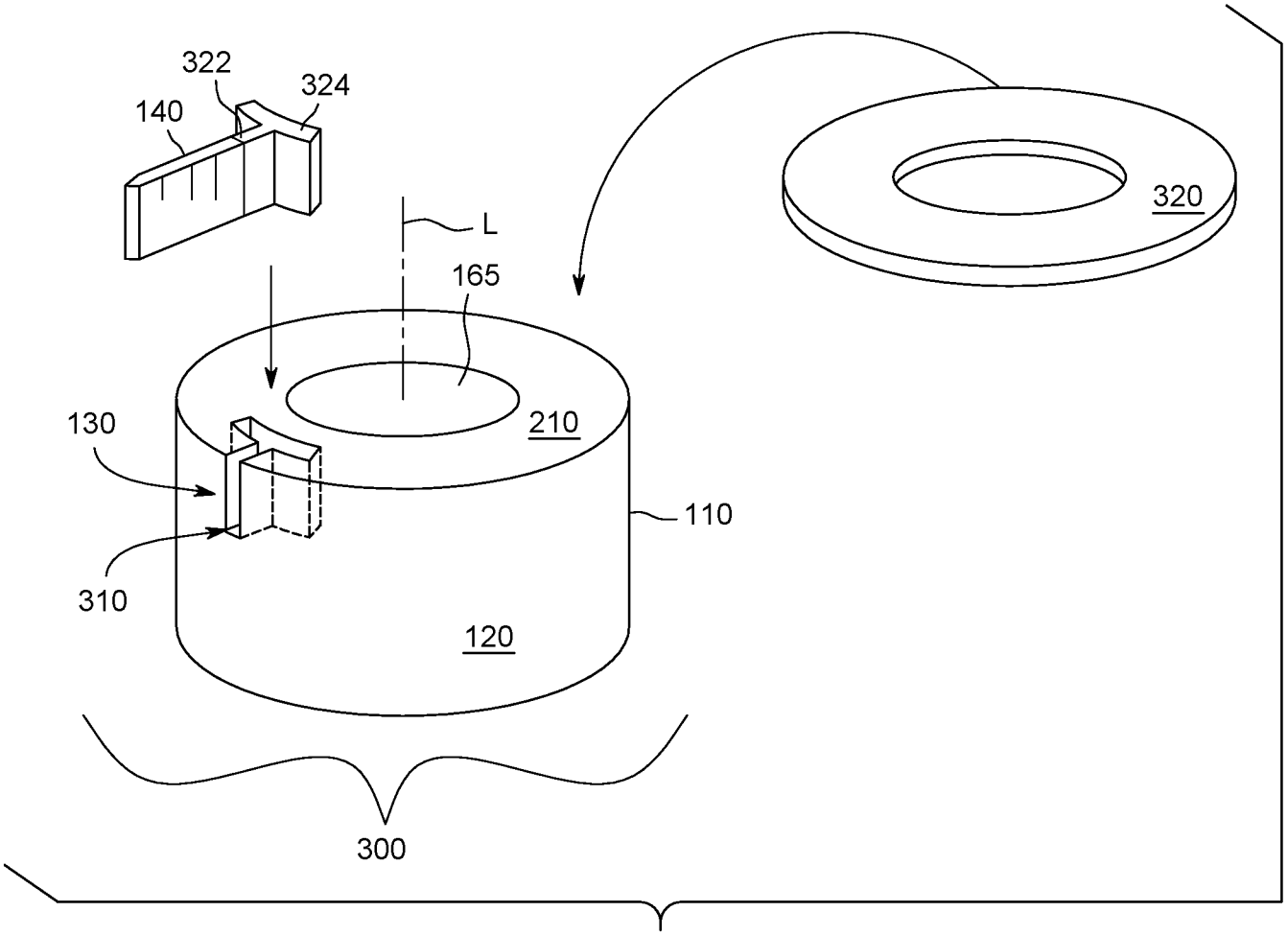
FIG. 3A is a perspective view of a fan apparatus with blind slot-type blade retention apertures, according to an embodiment.
Figure 3B:
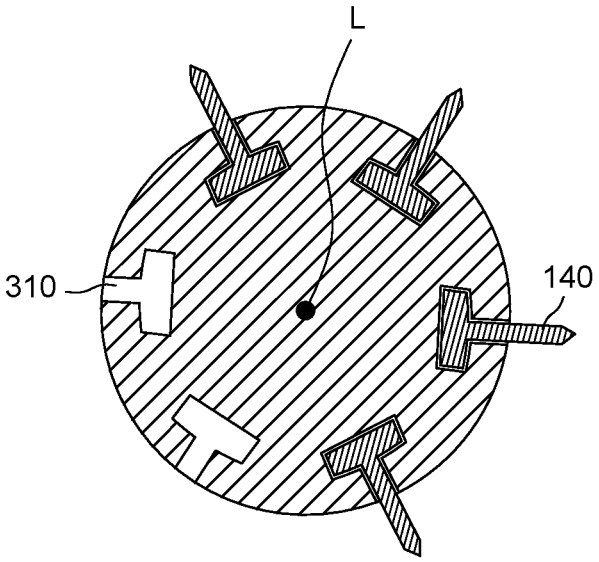
FIG. 3B is a top plan view of another embodiment of a fan apparatus with blind slot-type blade retention apertures.

In embodiments, the blade retention apertures are slots that are open to the top surface of the hub body. The slots may extend from the outer peripheral surface through to the inner peripheral surface (in the case where the hub body has a hollow interior), or the slots may be only open to the top and out through the outer peripheral wall, i.e., the slots could be blind slots that are enclosed radially inwards towards the center of the hub body. FIGS. 3A and 3B illustrate examples of the latter. As shown in FIG. 3A, a fan apparatus 300 has a hub body 110 comprising an annular top surface 210 interconnecting an inner peripheral wall 165 and an outer peripheral wall 120. The blade retention apertures 130 (only one is shown in FIG. 3A) comprise respective slots 310 in the hub body 110. The slots extend from the interior of the hub body (but short of the hollow area of the interior) to and through the outer peripheral wall, and are open across only part of the annular top surface. With this configuration, the fan blades 140 can be longitudinally inserted into and removed from the hub body in a direction of the central axis "L." In this embodiment, the fan apparatus further includes an end cap 320 that is configured to be attached to the hub body. When attached, the end cap at least partially covers the top surface and the interior of the hub body, at least to the extent to prevent the fan blades from being longitudinally removed from the slots (i.e., in the direction of the central axis "L"). This allows for easy repair of the fan apparatus if a fan blade breaks. For example, the end cap can be removed from the hub body, and if a partially detached/broken blade is still secured within the slot then it can be removed, and a new or repaired blade can be inserted longitudinally into the slot without having to remove the entire fan assembly or even the entire hub body.

The end cap may be attachable to the hub body by way of bolts, clips, screws, elastomer bands, or other retainers. For example, the hub body may be provided with tapped bolt holes, extending down into the hub body from the top surface thereof, that correspond (in terms of placement location and diameter) to fastener apertures provided in the end cap. Alternatively or additionally, the end cap may be attachable to parts other than the hub body. For example, the end cap could be attached to components (e.g., motor or other fan drive components) disposed in the hollow interior of the hub body. Regardless, the end cap is configured to be removably affixed into place relative to the hub body such that when affixed, the end cap at least partially covers the slots for preventing the fan blades from being longitudinally removed from the slots, and such that the end cap can be temporarily removed from its position covering the hub body (e.g., by a service technician using a tool) to allow for removal and replacement of fan blades into the slots.

FIG. 3B shows a hub body similar to the one shown in FIG. 3A (and illustrating plural slot-type blade retention apertures), but having a solid, non-hollow interior.

FIGS. 3A and 3B further illustrate an embodiment where the fan blades 140 are flared. Here, "flared" refers to having a head or other portion that extends perpendicularly outwards from a blade portion and/or another part of a base portion. Specifically, each fan blade has a base portion with a straight, uniform-width portion 322 that extends into the blade portion. Connected to the straight, uniform-width portion is a head 324 (or other protrusion(s)) that lies perpendicular to the straight portion, to form (generally speaking) a T-shape or cross (+)-shape in cross-section, and thereby, two perpendicular shoulders. The base portion is complementary in shape to the slots 310, such that when the base portion is received in a slot, the perpendicular shoulders of the head (or other, similar protrusion(s)) abut complementary-shaped cross-shoulders of the slot (see FIG. 3B), for retaining the fan blade base portion in the slot against radially-outwards movement.

Figure 4A:
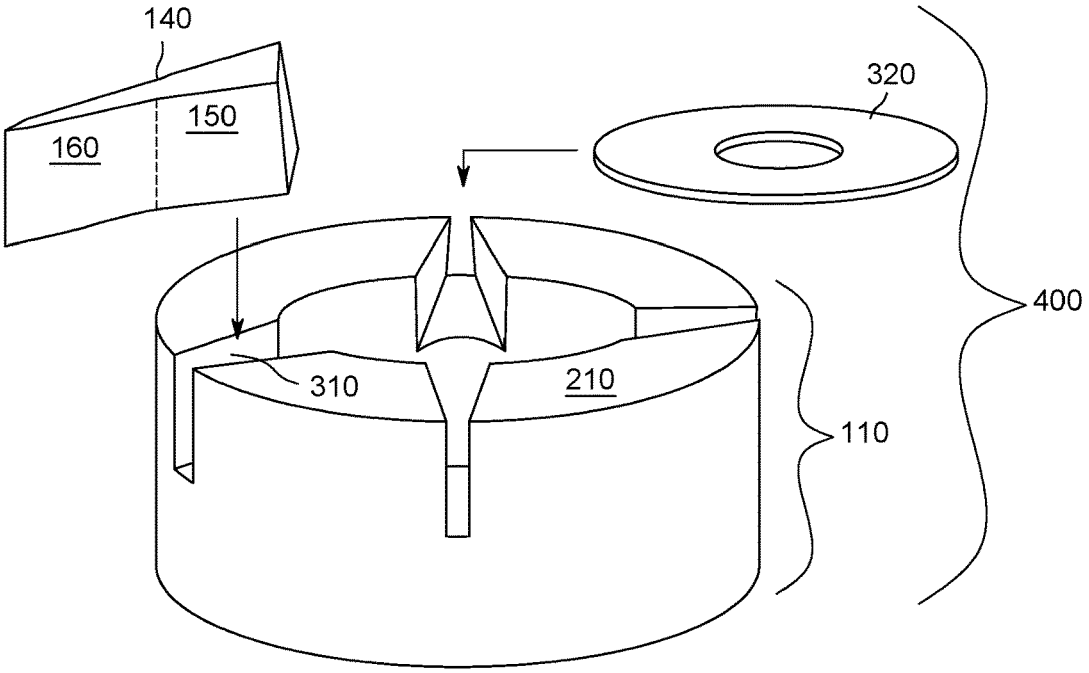
FIG. 4A is a perspective view of an embodiment of a fan apparatus with slot-type, tapered blade retention apertures.
Figure 4B:
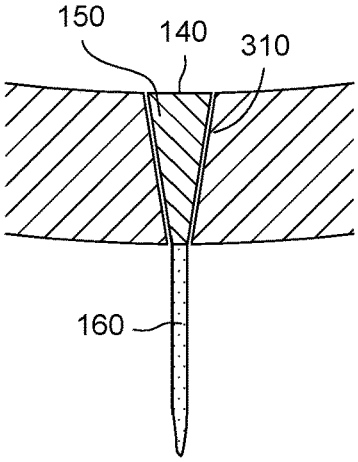
FIGS. 4B and 4C are enlarged views, in cross section, of embodiments of tapered blade retention apertures and fan blades with a complimentary-shaped, tapered base portions.
Figure 4C:
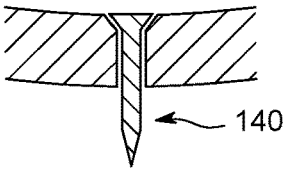

In embodiments where the hub body has blind slots (enclosed on the radially-inwards side of the hub body), instead of a flared fan blade base portion and complementary, T- or +-shaped slots in the hub body, the fan blade base portions are wholly tapered, with correspondingly-shaped slots, similar to what is shown in FIG. 4B. In other embodiments, the fan blade base portions are partially tapered, with correspondingly-shaped slots, similar to what is shown in FIG. 4C. In other embodiments, the fan blade base portions are both tapered and flared.

FIGS. 4A and 4B show an embodiment of a fan apparatus 400 having tapered slots 310 that extend from the outer peripheral wall of the hub body through to a hollow interior defined by an inner peripheral (concentrically inwards) wall. The slots, thereby, extend from and through the inner peripheral wall to and through the outer peripheral wall and are open across the top surface of the hub body. The fan apparatus further includes plural fan blades 140 (only one fan blade is shown in the figure). The fan blades and the slots are complementary in shape; in this embodiment, thereby, the base portions of the fan blades are tapered to correspond in shape to, and fit within, the tapered slots. The fan blades can be coupled to the hub body by being inserted into the slots in a longitudinal direction (i.e., in the direction of the hub body's central axis), as shown in FIG. 4A. However, because of the complementary shape (e.g., tapering), the fan blades cannot be removed from the hub body in a radial direction, and thereby are retained by the hub body even when the hub body is rotated about the central axis for operation of the fan apparatus. The fan apparatus may be provided with an end cap 320, as described above in regards to FIG. 3A.

As shown in FIG. 4C, instead of wholly tapered slots and fan blade base portions, the slots and fan blade base portions may be partially tapered.

Figure 5A:
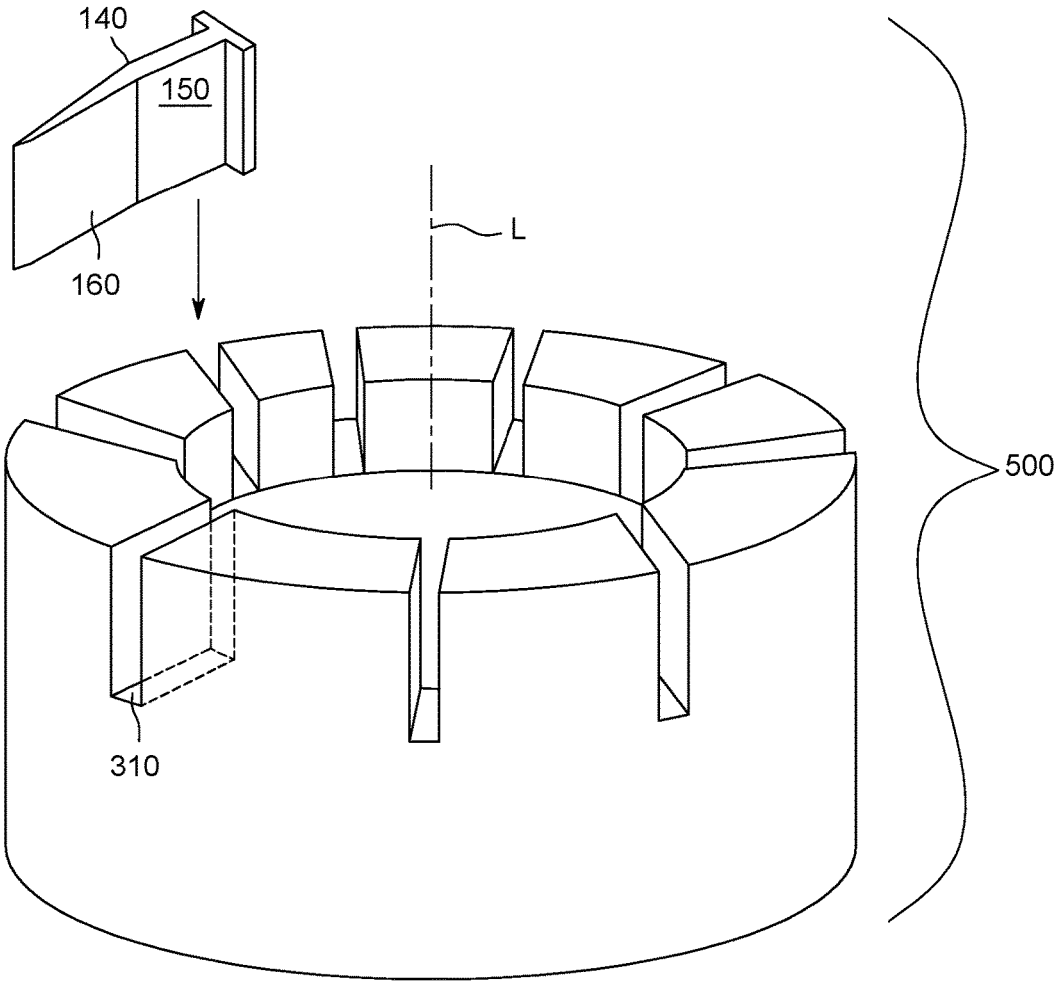
FIG. 5A is a perspective view of an embodiment of a fan apparatus with slot-type blade retention apertures.
Figure 5B:
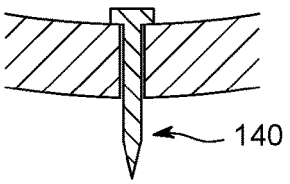
FIG. 5B is an enlarged detailed view, in cross section, of an embodiment of a fan blade with a flared base portion, disposed in a complementary-shaped slot.

FIGS. 5A and 5B show an embodiment of a fan apparatus 500 having non-tapered slots and complementary-shaped fan blade base portions, e.g., the slots are right rhombohedral in shape and thereby have a uniform rectangular cross-section area, in a plane perpendicular to the radius of the hub body, extending from the outer wall through to the inner wall. For retention against radial outwards movement, the fan blade base portions are flared, e.g., have a T-shaped head, such that when a fan blade is inserted into the slot, the perpendicular shoulders established by the head abut the inner wall of the hub body. In this manner, when the hub is rotated for operation of the fan apparatus, the fan blades are retained by the hub at least solely by centrifugal force. The fan apparatus 500 may further include an end cap as shown and described in regards to the other figures.

Figure 6A:
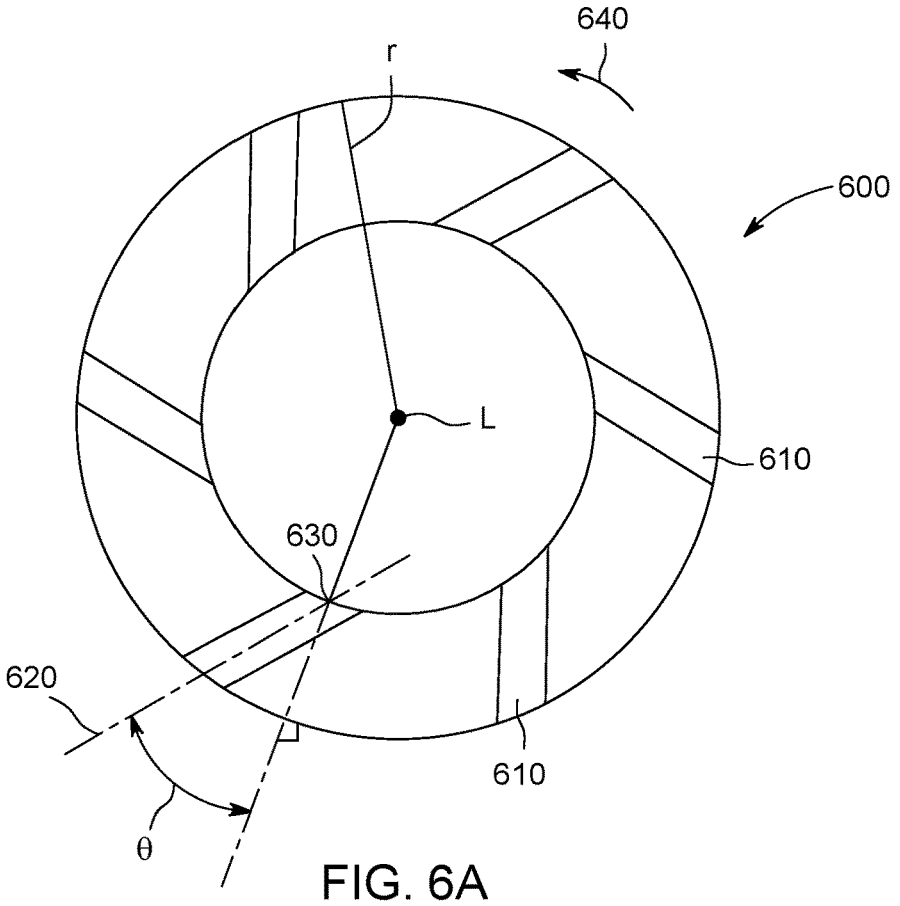
FIG. 6A is a top plan view of an embodiment of a fan apparatus with angled slots.

FIG. 6A shows an embodiment of a hub body 600 having radially-angled slots 610, that is, the slots are angled relative to a radial direction of the hub body. More specifically, each slot is oriented such that as between a long/major central axis 620 of the slot (i.e., long axis within a plane perpendicular to the central axis) and a radius "r" of the hub body that extends perpendicularly outwards from the central axis "L" of the hub body to the outer peripheral wall and through a center point 630 of the inner opening of the slot, there is a non-zero degree angle "θ." The slots may be angled away from the direction of rotational movement 640 of the hub body in operation, as shown in FIG. 6A, to reduce the risk of fan blade breakage.

Figure 6B:
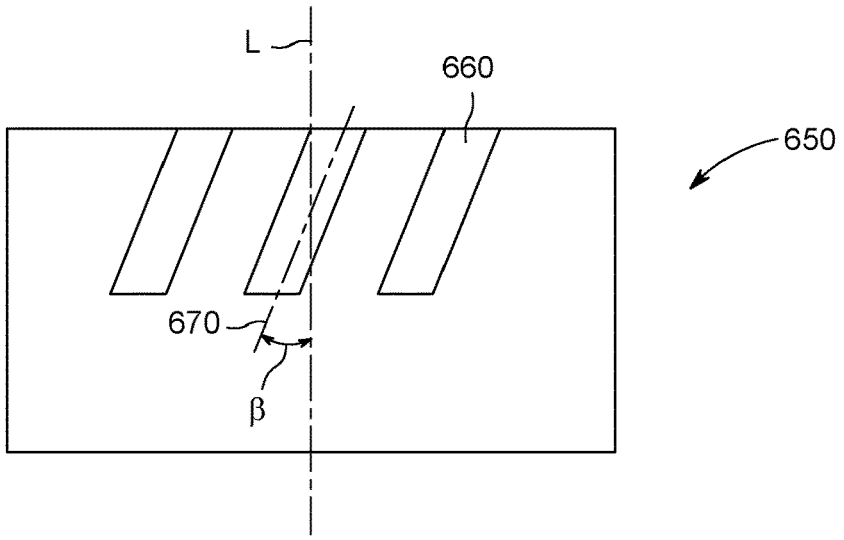
FIG. 6B is a side elevation view of another embodiment of a fan apparatus with angled slots.

FIG. 6B shows an embodiment of a hub body 650 having longitudinally-angled slots 660, that is, the slots are angled relative to the central axis of the hub body. More specifically, each slot is oriented such that as between a long/major central axis 670 of the slot (from the perspective of the side of the hub, i.e., an axis within a plane parallel to the central axis) and the central axis "L" of the hub body, there is a non-zero degree angle "β."

Figure 7:
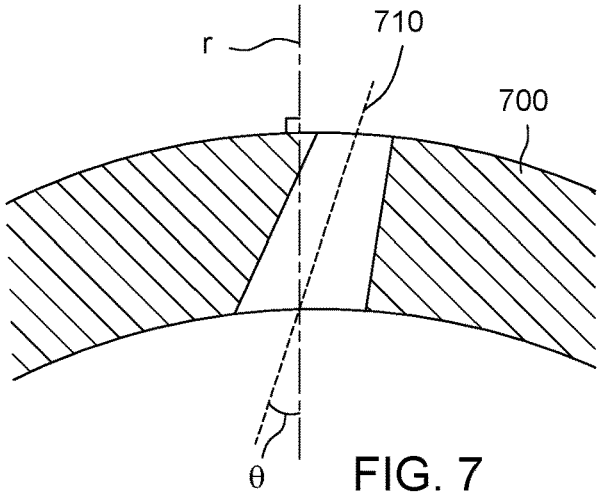
FIG. 7 is an enlarged detailed view, in cross section, of an embodiment of a fan apparatus with an angled and tapered blade retention aperture.

In other embodiments, and similar to FIG. 6A or FIG. 6B, a hub body may have angled, hole-type blade retention apertures. For example, FIG. 7 shows a detailed view of part of a hub body 700 having a radially-angled hole 710 for retaining a complementary-shaped fan blade. (Plural additional such holes would be provided around the hub body, for retaining additional fan blades.) FIG. 7 also shows that angled blade retention apertures (holes or slots) may also be tapered, e.g., there is a non-zero degree angle "θ" between a long axis of the hole or slot and a radius "r," and the inner opening of the hole or slot is wider and/or has a greater area than the outer opening of the hole or slot.

In embodiments, blade retention apertures may be both radially (FIG. 6A) and longitudinally (FIG. 6B) angled.

Figure 8A:
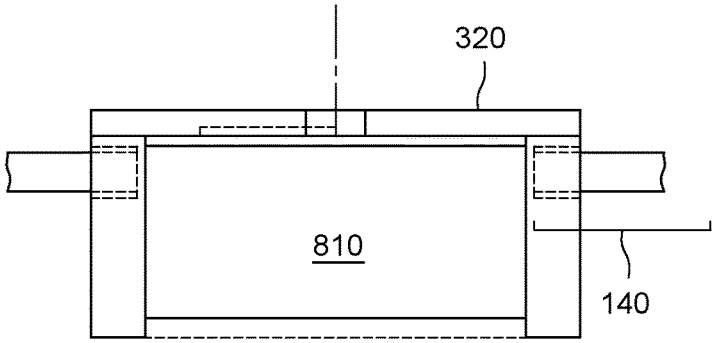
FIGS. 8A and 8B are schematic drawings of a fan apparatus, showing embodiments of fan blade securing devices.
Figure 8B:
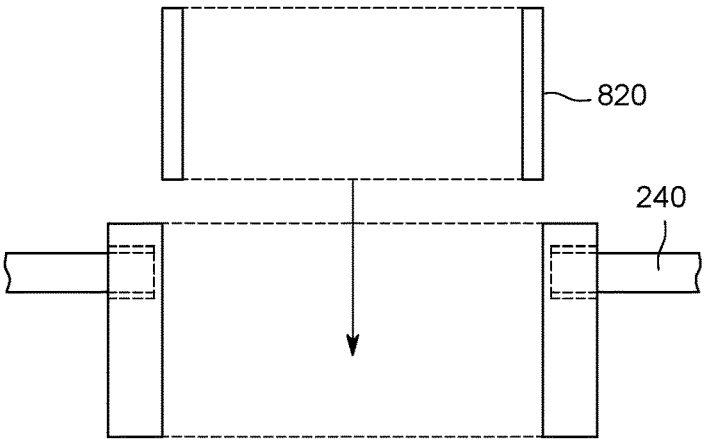

In embodiments where the hub body has a hollow interior and slots or holes that extend through to the hollow interior (see, e.g., FIGS. 1, 4A, and 5A), the fan apparatus may further include a securing device or means for securing the plural fan blades from radially-inwards movement, i.e., for preventing the fan blades from moving inwards towards the central axis of the hub body. As shown in FIG. 8A, the securing device or means may include a drive mechanism 810 that is located in the hollow interior and configured to rotate the hub body. For example, for fan assemblies that are driven by electric motors, the hub body may be disposed over the electric motor or part thereof, which thereby lies within the hollow interior of the hub body. The hub body is dimensioned for a very close clearance/engagement with the motor, such that the motor (or part thereof) abuts or nearly abuts the inner wall of the hub body where the blade retention aperture inner openings are located. This close clearance prevents the fan blades from moving inwards. Gear drives and other mechanical drive mechanisms may be similarly configured. As shown in FIG. 8B, in another embodiment the securing means or device is a removable retaining feature 820, such as an annular collar or annular ring. The annular collar has outer dimensions (e.g., an outer diameter) that match the inner dimensions (e.g., an inner diameter) of the hub body interior. In use, the collar is disposed in the interior against the inner wall of the hub body where the blade retention aperture inner openings are located. The collar thereby prevents the fan blades from moving inwards. Other securing means may include set screws or other fasteners for each individual blade, other types/shapes of retainer collars, solid (e.g., disc-shaped) retainers of various materials, etc. In one embodiment, the securing means is a foam solid, for weight reduction, it being recognized that in some aspects, the securing means may not have to regularly accommodate a significant force. In another embodiment, the securing means or device is elastic (e.g., deformable polymer collar), thereby allowing the fan blades to move inwards slightly, which may help in terms of reducing fan blade breakage due to the elastic securing means or device acting as a shock absorber. In some embodiments, the retaining feature 820 may be fastened to the hub body to be held in place while the hub is rotated for operation of the fan apparatus. In other embodiments, the retaining feature may have a shape complimentary to the shape of the interior of the hub body so no fastening mechanism is needed.

Figure 9:
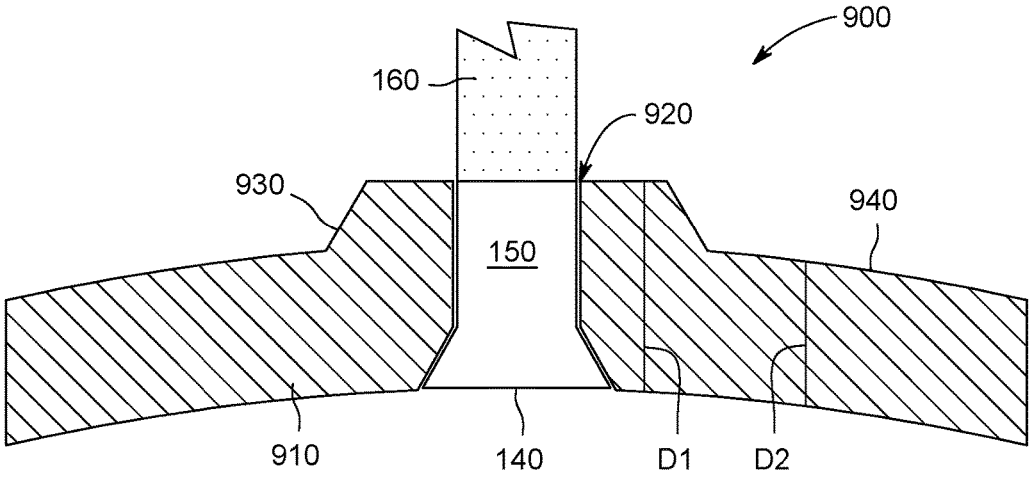
FIG. 9 is a cross-sectional view of a retaining aperture with a fluted fan blade egress design, according to an embodiment.

FIG. 9 is a partial view of an embodiment of a fan apparatus 900 having a hub body 910 with fluted blade retention apertures 920. (Only one fluted blade retention aperture is shown in FIG. 9, however, the hub body would be provided with additional such apertures spaced around the hub body.) The fluted blade retention aperture may be generally similar to those discussed elsewhere herein (e.g., a hole or slot), but further includes a landing or extension 930 that extends radially outwards past the outer peripheral wall 940 to surround an additional part of the fan blade 140 (versus a uniform outer peripheral wall without fluted blade retention apertures), i.e., the hub body is thicker "D1," in a radial direction, around the outer openings of the blade retention apertures than in the area "D2" in the middle between adjacent apertures (for example). The fluted blade retention apertures may function to provide a more robust interface between the hub body and fan blades, by creating a stricter "lock and key" fit between the fan blade base portions and the retention apertures. Further, the stricter fit of this embodiment may reduce adverse effects if issues of resonance or vibration arise when the hub is rotated for operation of the fan apparatus.

Figure 10:
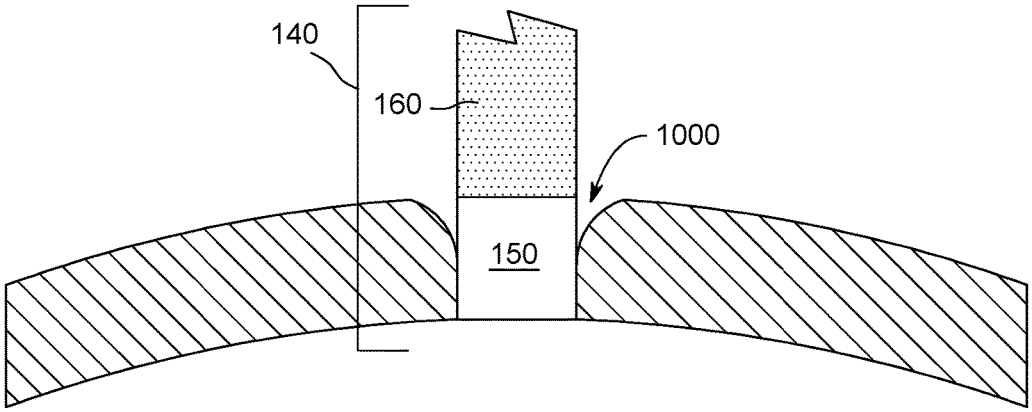
FIGS. 10 and 11 are cross-sectional views of embodiments of retaining apertures with rounded and chamfered edges, respectively.
Figure 11:
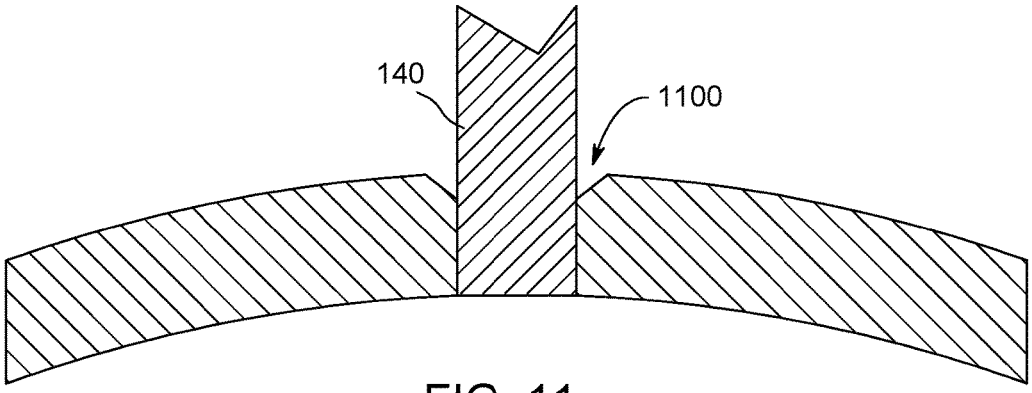

As illustrated in FIG. 10, in any of the embodiments herein, the edges 1000 of the outer peripheral wall of the hub body that define the outer openings of the blade retention apertures (i.e., blade retention aperture outer edges) may be rounded. The rounded edge may help in terms of avoiding a stress riser and lessens the strain put on the fan blades when inserted in the retention apertures. As shown in FIG. 11, alternatively, the blade retention aperture outer edges 1100 may be chamfered or beveled.

Figure 12:
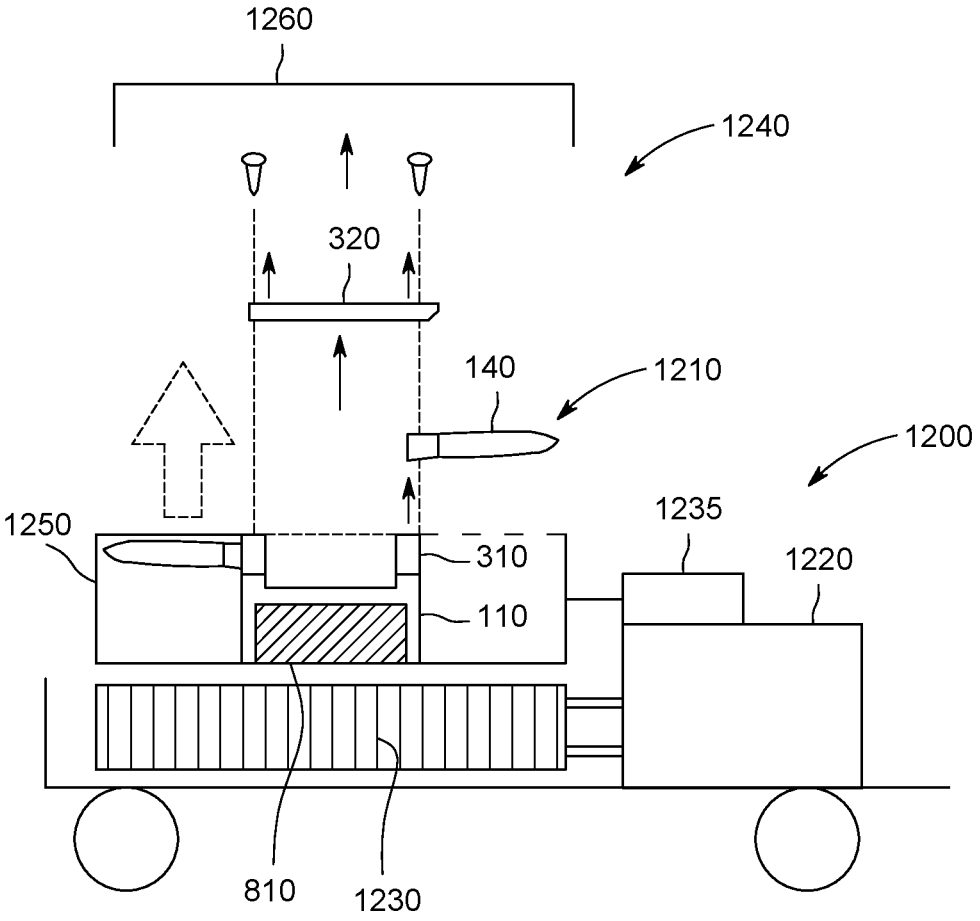
FIG. 12 is a side elevation schematic view of a vehicle (not to scale) having a fan apparatus, and also illustrating a servicing method, according to embodiments of the invention.

FIG. 12 shows an embodiment of a land vehicle (e.g., locomotive or other rail vehicle, haul truck, other off-road vehicle, or automobile, tractor-trailer, or other on-road vehicle) 1200 having a fan apparatus 1210 as described herein, e.g., a fan apparatus where the hub body has slots such that fan blades can be removed in a longitudinal direction without having to move/remove the hub body. The vehicle includes wheels, a frame/chassis/support platform, and a heat source (e.g., engine, energy storage device, power electronics, combinations thereof, or the like) 1220, which is operably coupled with a cooling system 1230, e.g., radiator or other heat exchanger. The fan apparatus is operably coupled to the cooling system so that when the fan apparatus is powered for rotation of the hub body and fan blades (e.g., under control of a control unit 1235, which may include a processor or other electric circuits), the fan apparatus provides a flow of air to the cooling system to facilitate the transfer of thermal energy from the cooling system to the air and thereby to ambient (external to the vehicle). For replacement of fan blades or similar servicing, the fan apparatus is accessed in the vehicle by removing any external access panels or other access members. For example, the fan apparatus may include a cage 1240 with a basket-like lower cage portion 1250 surrounding the blades and a removable cage cover 1260; the cage includes perforations, gaps, or other apertures that are spaced fine enough for safety but large enough for a desired degree of air flow. For accessing the fan assembly interior, the cover is removed from the lower cage portion, by actuating any applicable fasteners that normally serve to keep the cover in place. This exposes the end cap 320, which can be removed, again, by actuating any applicable fasteners that normally serve to keep the end cap in place. Once the end cap is detached, any of the fan blades (e.g., a damaged fan blade) can be removed from retention in the hub body simply by moving the fan blade in a longitudinal direction, e.g., upwards. Once a replacement fan blade is put in place in the now-empty blade retention slot, the end cap and cover are re-attached and the servicing is complete. Thus, it may be possible to replace fan blades in the fan apparatus without having to remove the hub or hub body from the vehicle.

In embodiments, the fan apparatus is installed in place on board a locomotive, in operable connection with a radiator of the locomotive.

In embodiments, a fan apparatus includes one, and only one, set of fan blades, which are co-planar. As opposed to, for example, 'stacks' of plural banks of fan blades that rotate commonly about an axis. This reflects that in embodiments, fan blade replacement is facilitated by having unimpeded access to the fan blades in a longitudinal direction, other than having to detach an end cap and safety cage (or other access members), and without having to detach one fan blade or group of fan blades to get to another, broken fan blade.

In any of the embodiments herein, the blade retention apertures, when viewed in totality (i.e., all the blade retention apertures of a given hub) may be evenly/symmetrically spaced around the hub body to maintain balance when the hub is rotated for operation of the fan apparatus. Additionally, there may be an even number (e.g., 4, 6, or 8) of blade retention apertures. In this embodiment, if a fan blade breaks, the broken fan blade and the fan blade exactly opposite from the broken fan blade can be removed to rebalance the fan. This provides a quick method for temporarily fixing the fan apparatus so it can remain functional until a more permanent and complete repair can occur.

Figure 13:
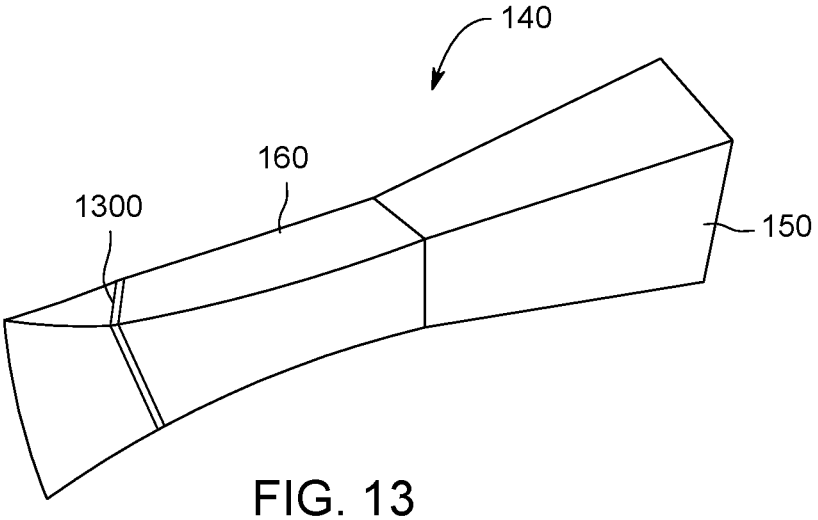
FIG. 13 is a perspective view of an embodiment of a fan blade.

In an embodiment, with reference to FIG. 13, each of the plural fan blades 140 has a respective break line 1300 configured for the fan blade to break preferentially at an intermediate-point on the fan blade away from where the fan blade enters the hub body. An intermediate-point on a fan blade can be any location on the fan blade other than one of the two respective ends, or any point between the distal tip/edge of the fan blade portion and where the fan blade enters the hub body. In this embodiment, part of the blade may be salvaged should an event occur that damages a fan blade. If the damaged portion of the blade breaks off at the break line, the fan apparatus may continue to function temporarily if service to fix the damaged blade does not occur immediately. In some instances, when a fan blade is welded to the hub body, if the weld fails, the entire fan blade will become detached from the hub body, creating an ejection hazard. If a break line is present on a fan blade, however, as shown in FIG. 13, this increases the likelihood that only a portion of the fan blade will be detached, thereby minimizing the ejection hazard and minimizing the risk to personnel from the liberated material. The break line may be a lessening of an amount of material of the fan blade portion in that region (e.g., score line, or perforations), or an intentional material weakness, relative to portions of the blade portion on either side of the break line.

In any of the embodiments herein, the hub body may be comprised of a first, metal material, and the fan blades may be comprised of at least one second material that is different than the first, metal material. The at least one second material could be one or more of, but is not limited to, a polymer, a second metal, carbon fiber, fiberglass, metal wire, a cast material, mineral filing, non-moisture absorbing materials, or combinations thereof. In one embodiment, the hub body is metal, and the fan blades are made of a polymer or polymer composite (including carbon fiber composites and mineral-filled composites). In an embodiment, the at least one second material includes polyurethane resin, that is, the fan blades are made of a polyurethane resin, or polyurethane resin composite. Polyurethane is able to withstand extreme temperatures and weather conditions, and thereby it may be suitable for use in the context of vehicle cooling systems, which may be subject to such conditions. In embodiments, the fan blades are 3-D printed parts.

In any of the embodiments herein, the fan blades may be provided with wear resistant coatings, such as a diamond-like carbon (DLC) coating. The fan blades may alternatively or additionally be provided with hydrophobic (snow/water shedding) coatings, or coatings that are both wear resistant and hydrophobic.

In an embodiment, the hub body is comprised of a first metal material, and the fan blades are comprised of the first metal material and/or a second metal material, and the fan blades are spot welded to the hub body to reinforce the attachment of the blades within the plural blade retention apertures. In another embodiment, the fan blade base portions are metal, for additional attachment to the hub body by spot welding, and the blade portions are a polymer, polymer composite, or other material that is not fully/only metal.

In another embodiment, the fan blades are additionally affixed to the hub body using an adhesive. Alternatively or additionally, engagement between the fan blades and hub body may be reinforced using shims or the like.

In an embodiment, a fan apparatus includes a hub having an annular hub body with an outer peripheral wall, and interior, a central axis, a top surface, and an opposing bottom surface. The hub body defines plural blade retention slots spaced apart from one another around the hub body and extending radially outward from the interior through to the outer peripheral wall. The plural blade retention slots are only partially enclosed by the hub body so the top surface of the hub body defines respective top openings of the slots. Additionally, the plural fan blades have respective base portions attached to respective blade portions, and the base portions are respectively removably disposed in the plural blade retention slots with the blade portions extending radially outwards from the outer peripheral wall. The base portions are at least one of tapered or flared for engagement with complementary features of the hub body for the fan blades to be retained by the hub at least solely by centrifugal force when the hub is rotated for operation of the fan apparatus. In this embodiment, there is an end cap fastened to the hub body and configured to at least partially cover the top openings of the slots to prevent the fan blades from being longitudinally removed from the slots in a direction of the central axis.

In an embodiment, a method for a fan apparatus (e.g., for servicing and/or controlling a fan apparatus) includes moving (e.g., removing) one or more access members to access the fan apparatus, and removing an end cap of the fan apparatus from a hub of the fan apparatus. The end cap, when attached to the hub, prevents plural fan blades of the fan apparatus from being longitudinally removed from the hub. The method further includes replacing a broken or missing one of the fan blades by longitudinal insertion of a replacement fan blade into a blade retention slot of the broken or missing one of the fan blades. (The blade retention slot of the broken or missing one of the fan blades is disposed in a top surface of the hub.) The method further includes, alternatively or additionally: removing an opposite fan blade of the plural fan blades that is opposite the broken or missing one of the fan blades, in a longitudinal direction from a blade retention slot of the opposite fan blade in the top surface of the hub, and if the broken or missing one of the fan blades is broken, removing the broken fan blade in the longitudinal direction from the blade retention slot of the broken or missing one of the fan blades. Then, the end cap and access members are replaced. The method further includes, responsive to replacement of the broken or missing one of the fan blades, automatically controlling the fan apparatus, with a control unit, according to a first duty cycle (referring to a proportion of time the fan apparatus is operated, and during the time of operation, how it is operated, e.g., speed), and responsive to removal of the opposite fan blade, automatically controlling the fan apparatus according to a second duty cycle that is different than the first duty cycle. For example, the second duty cycle may include operating the fan apparatus for a longer time, and/or at a faster speed, than the first duty cycle, to accommodate the fan apparatus having two fewer fan blades than the total number of its possible fan blades. Information of whether a fan blade was replaced, or an opposite fan blade removed, may be inputted into the control unit via an operator interface, or it may be determined (for example) based on information received from sensors operably disposed in or near the blade retention slots. In embodiments, the steps of the method are carried out in the field, without removal of any parts of the fan apparatus (or at least without removal of the hub) except for the end cap and broken or missing fan blade. For example, the steps of moving the one or more access members, removing the end cap, replacing the broken or missing one of the fan blades and/or removing the opposite fan blade, and replacing the end cap and one or more access members may be carried out in a vehicle parked along a route of the vehicle, and the steps of operating the fan apparatus may be carried out when the vehicle is parked and/or when the vehicle is moving along a route. In either instance, the steps may be carried out when the vehicle is out on a trip along the route, and not in a maintenance facility.

In another embodiment, a method for controlling a fan apparatus includes, with a control unit, automatically operating the fan apparatus according to a first duty cycle responsive to replacement of a broken or missing fan blade of the fan apparatus. The method further includes, with the control unit, automatically operating the fan apparatus according to a different, second duty cycle responsive to removal of an opposite fan blade of the fan apparatus that is positioned opposite the broken or missing fan blade, such that the fan apparatus is operated with two missing fan blades. (If the fan blade is broken but with a portion of the broken fan blade still connected to the fan apparatus, the broken portion is removed from the fan apparatus prior to operation.) The fan apparatus may be configured, such as with a slotted hub having longitudinally removable fan blades, for replacement and/or removal of fan blades in the field, without having to remove any parts of the fan apparatus, or at least not the fan hub, other than the fan blades and an end cap or other removable retainer that when attached prevents the fan blades from being removed longitudinally (in the direction of the central axis/axis of rotation of the fan apparatus). The steps of operating the fan apparatus may be carried out when the vehicle is parked and/or when the vehicle is moving along a route, e.g., when the vehicle is out on a trip along the route, and not in a maintenance facility.

In another embodiment, a fan blade for a fan apparatus includes a base portion and a blade portion. The blade portion is attached to the base portion. The base portion is configured to be removably received in a blade retention aperture of a hub of the fan apparatus in one of a radial or a longitudinal direction (e.g., as described in regards to any of the other embodiments set forth herein). The base portion is complementary in shape to the blade retention aperture for the fan blade to be retained by the hub at least solely by centrifugal force when the hub is rotated for operation of the fan apparatus.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. The plural fan blades comprise respective base portions attached to respective blade portions. The base portions are disposed in the plural blade retention apertures with the blade portions extending radially outwards from the outer peripheral wall. The base portions are at least one of tapered or flared for retention by the hub body.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. The plural fan blades comprise respective base portions attached to respective blade portions. The base portions are disposed in the plural blade retention apertures with the blade portions extending radially outwards from the outer peripheral wall. The base portions are at least one of tapered or flared for retention by the hub body. The interior of the hub body is hollow, and the hub body further includes an inner peripheral wall spaced radially concentrically inwards from the outer peripheral wall and defining the interior. The blade retention apertures extend from and through the inner peripheral wall to and through the outer peripheral wall.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. The plural fan blades comprise respective base portions attached to respective blade portions. The base portions are disposed in the plural blade retention apertures with the blade portions extending radially outwards from the outer peripheral wall. The base portions are at least one of tapered or flared for retention by the hub body. The interior of the hub body is hollow, and the hub body further includes an inner peripheral wall spaced radially concentrically inwards from the outer peripheral wall and defining the interior. The blade retention apertures extend from and through the inner peripheral wall to and through the outer peripheral wall. The hub body includes an annular top surface interconnecting the inner peripheral wall and the outer peripheral wall, and the blade retention apertures comprise respective slots in the hub body, the slots extending from and through the inner peripheral wall to and through the outer peripheral wall and being open across the annular top surface such that the fan blades are longitudinally removable from the hub body in a direction of the central axis.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. The plural fan blades comprise respective base portions attached to respective blade portions. The base portions are disposed in the plural blade retention apertures with the blade portions extending radially outwards from the outer peripheral wall. The base portions are at least one of tapered or flared for retention by the hub body. The interior of the hub body is hollow, and the hub body further includes an inner peripheral wall spaced radially concentrically inwards from the outer peripheral wall and defining the interior. The blade retention apertures extend from and through the inner peripheral wall to and through the outer peripheral wall. The hub body includes an annular top surface interconnecting the inner peripheral wall and the outer peripheral wall, and the blade retention apertures comprise respective slots in the hub body, the slots extending from and through the inner peripheral wall to and through the outer peripheral wall and being open across the annular top surface such that the fan blades are longitudinally removable from the hub body in a direction of the central axis. The apparatus further includes an end cap attached to the hub body and at least partially covering the top surface and the interior. The end cap prevents the fan blades from being removed from the slots in the direction of the central axis.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. The plural fan blades comprise respective base portions attached to respective blade portions. The base portions are disposed in the plural blade retention apertures with the blade portions extending radially outwards from the outer peripheral wall. The base portions are at least one of tapered or flared for retention by the hub body. The interior of the hub body is hollow, and the hub body further includes an inner peripheral wall spaced radially concentrically inwards from the outer peripheral wall and defining the interior. The blade retention apertures extend from and through the inner peripheral wall to and through the outer peripheral wall. The hub body includes an annular top surface interconnecting the inner peripheral wall and the outer peripheral wall, and the blade retention apertures comprise respective slots in the hub body, the slots extending from and through the inner peripheral wall to and through the outer peripheral wall and being open across the annular top surface such that the fan blades are longitudinally removable from the hub body in a direction of the central axis. The slots are angled, as defined by long central axes of the slots being oriented at one or more non-zero degree angles relative to a radius of the hub body, the radius extending perpendicularly between the central axis and the outer peripheral wall.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. The plural fan blades comprise respective base portions attached to respective blade portions. The base portions are disposed in the plural blade retention apertures with the blade portions extending radially outwards from the outer peripheral wall. The base portions are at least one of tapered or flared for retention by the hub body. The interior of the hub body is hollow, and the hub body further includes an inner peripheral wall spaced radially concentrically inwards from the outer peripheral wall and defining the interior. The blade retention apertures extend from and through the inner peripheral wall to and through the outer peripheral wall. The hub body comprises an annular top surface interconnecting the inner peripheral wall and the outer peripheral wall, and the blade retention apertures comprise holes extending from and through the inner peripheral wall to and through the outer peripheral wall and being at least partially enclosed by the annular top surfaces.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. The plural fan blades comprise respective base portions attached to respective blade portions. The base portions are disposed in the plural blade retention apertures with the blade portions extending radially outwards from the outer peripheral wall. The base portions are at least one of tapered or flared for retention by the hub body. The respective base portion of each fan blade of the plural fan blades has a first edge and a second edge. At least one of the first edge or the second edge is a beveled edge configured to be secured within the blade retention apertures having beveled edges complimentary to the beveled edge of the fan blade.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. Outer edges of the blade retention apertures at the outer peripheral wall are at least one of chamfered or rounded.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. The hub body is comprised of a first, metal material, and the fan blades are comprised of at least one second material that is different than the first, metal material.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. The hub body is comprised of a first, metal material, and the fan blades are comprised of at least one second material that is different than the first, metal material. The at least one second material is one or more of a polymer, a second metal, carbon fiber, fiberglass, metal wire, a cast material, mineral filling, or combinations thereof. For example, if the at least one second material is the polymer, the polymer may comprise a polyurethane resin.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. The plural blade retention apertures are even in number in totality and are arranged symmetrically around the hub body to maintain balance when the hub is rotated for operation of the fan apparatus (e.g., even with two missing fan blades).

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. The apparatus further includes securing means for securing the plural fan blades within the plural blade retention apertures to prevent the fan blades from moving inward towards the central axis in the interior of the hub body.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. Each of the plural fan blades has a respective break line configured for the fan blade to break preferentially at an intermediate-point on the fan blade away from where the fan blade enters the hub body.

In an embodiment, a fan apparatus includes a hub comprising an annular hub body having an outer peripheral wall, an interior, and a central axis. The hub body defines plural blade retention apertures spaced apart from one another around the hub body and extending radially outward from the interior through to the outer peripheral wall. The apparatus further includes plural fan blades respectively removably disposed in the plural blade retention apertures. The fan blades and the blade retention apertures are complimentary in shape to one another for the fan blades to be retained by the hub at least solely by centrifugal force when the hub is rotated for operation of the fan apparatus. The hub body is comprised of a first metal material, and the fan blades are comprised of one of the first metal material or a second metal material, and the fan blades are spot welded to the hub body to reinforce the attachment of the blades within the plural blade retention apertures.

In an embodiment, a fan apparatus includes a hub comprising an annular hub body having an outer peripheral wall, an interior, a central axis, and a top surface. The hub body defines plural blade retention slots spaced apart from one another around the hub body, the blade retention slots extending radially outward from the interior through to the outer peripheral wall and having top openings across at least part of the top surface of the hub body. The apparatus further includes plural fan blades having respective base portions attached to respective blade portions. The base portions are respectively removably disposed in the plural blade retention slots with the blade portions extending radially outwards from the outer peripheral wall. The base portions are at least one of tapered or flared for engagement with complementary features of the hub body for the fan blades to be retained by the hub at least solely by centrifugal force when the hub is rotated for operation of the fan apparatus. The apparatus further includes an end cap fastened to the hub body and configured to at least partially cover the top openings of the slots to prevent the fan blades from being longitudinally removed from the slots in a direction of the central axis. In another embodiment, the interior of the hub body is hollow and defined by an inner peripheral wall, the top surface interconnecting the outer peripheral wall and the inner peripheral wall, and the blade retention slots are open across the top surface from the inner peripheral wall to the outer peripheral wall. Additionally or alternatively, the slots may be at least one of radially angled or longitudinally angled relative to a radius or the central axis of the hub body, respectively.

In another embodiment, a vehicle includes a heat exchanger and a fan apparatus operably coupled to the heat exchanger (e.g., to blow air across/through the heat exchanger). The fan apparatus includes a hub comprising an annular hub body having an outer peripheral wall, an interior, a central axis, and a top surface. The hub body defines plural blade retention slots spaced apart from one another around the hub body, the blade retention slots extending radially outward from the interior through to the outer peripheral wall and having top openings across at least part of the top surface of the hub body. The apparatus further includes plural fan blades having respective base portions attached to respective blade portions. The base portions are respectively removably disposed in the plural blade retention slots with the blade portions extending radially outwards from the outer peripheral wall. The base portions are at least one of tapered or flared for engagement with complementary features of the hub body for the fan blades to be retained by the hub at least solely by centrifugal force when the hub is rotated for operation of the fan apparatus. The apparatus further includes an end cap fastened to the hub body and configured to at least partially cover the top openings of the slots to prevent the fan blades from being longitudinally removed from the slots in a direction of the central axis. The fan apparatus is configured for each fan blade of the plural fan blades to be accessed for removal from the hub body in the direction of the central axis, when the end cap is removed, and without having to detach any others of the fan blades or any other fan blades of the vehicle. The interior of the hub body may be hollow and defined by an inner peripheral wall, the top surface interconnecting the outer peripheral wall and the inner peripheral wall, and the blade retention slots are open across the top surface from the inner peripheral wall to the outer peripheral wall. Additionally or alternatively, the slots may be at least one of radially angled or longitudinally angled relative to a radius or the central axis of the hub body, respectively.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described subject matter without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

What is claimed is:

1. A fan apparatus comprising:

a hub comprising an annular hub body having an outer peripheral wall, an interior, and a central axis, wherein the hub body defines plural blade retention apertures spaced apart from one another around the hub body and extending radially outward from the interior through to the outer peripheral wall; and plural fan blades respectively removably disposed in the plural blade retention apertures, wherein the fan blades and the blade retention apertures are complementary in shape to one another for the fan blades to be retained by the hub at least solely by centrifugal force when the hub is rotated for operation of the fan apparatus, and wherein the blade retention apertures comprise respective slots that extend from respective openings in the interior through to openings in the outer peripheral wall, the slots being partially tapered where, for each respective slot, a first portion of the slot is tapered in a direction extending from the interior to the outer peripheral wall and a second portion of the slot is not tapered in the direction extending from the interior to the outer peripheral wall.

2. The apparatus of claim 1, wherein the plural fan blades comprise respective base portions attached to respective blade portions, wherein the base portions are disposed in the plural blade retention apertures with the blade portions extending radially outwards from the outer peripheral wall, wherein the base portions are at least one of tapered or flared for retention by the hub body.

3. The apparatus of claim 2, wherein the interior of the hub body is hollow, and the hub body further includes an inner peripheral wall spaced radially concentrically inwards from the outer peripheral wall and defining the interior, and the blade retention apertures extend from and through the inner peripheral wall to and through the outer peripheral wall, wherein the openings in the interior comprise openings in the inner peripheral wall.

4. The apparatus of claim 3, wherein a top surface of the hub body comprises an annular top surface interconnecting the inner peripheral wall and the outer peripheral wall, the slots extending from and through the inner peripheral wall to and through the outer peripheral wall and being open across the annular top surface such that the fan blades are longitudinally removable from the hub body in a direction of the central axis.

5. The apparatus of claim 4, further comprising an end cap attached to the hub body and at least partially covering the top surface and the interior, the end cap preventing the fan blades from being removed from the slots in the direction of the central axis.

6. The apparatus of claim 4, wherein the slots are angled, as defined by long central axes of the slots being oriented at one or more non-zero degree angles relative to a radius of the hub body, the radius extending perpendicularly between the central axis and the outer peripheral wall.

7. The apparatus of claim 3, wherein the hub body comprises an annular top surface interconnecting the inner peripheral wall and the outer peripheral wall, and the slots are at least partially enclosed by the annular top surface.

8. The apparatus of claim 2, wherein the respective base portion of each fan blade of the plural fan blades has a first edge and a second edge, wherein at least one of the first edge or the second edge is a beveled edge configured to be secured within the blade retention apertures having beveled edges complementary to the beveled edge of the fan blade.

9. The apparatus of claim 1, wherein outer edges of the blade retention apertures at the outer peripheral wall are at least one of chamfered or rounded.

10. The apparatus of claim 1, wherein the hub body is comprised of a first, metal material, and the fan blades are comprised of at least one second material that is different than the first, metal material.

11. The apparatus of claim 10, wherein the at least one second material is one or more of a polymer, a second metal, carbon fiber, fiberglass, metal wire, a cast material, mineral filling, or combinations thereof.

12. The apparatus of claim 11, wherein the at least one second material is the polymer, the polymer comprising a polyurethane resin.

13. The apparatus of claim 1, wherein the plural blade retention apertures are even in number in totality and are arranged symmetrically around the hub body to maintain balance when the hub is rotated for operation of the fan apparatus.

14. The apparatus of claim 1, further comprising securing means for securing the plural fan blades within the plural blade retention apertures to prevent the fan blades from moving inward towards the central axis in the interior of the hub body.

15. The apparatus of claim 1, wherein each of the plural fan blades has a respective break line configured for the fan blade to break preferentially at an intermediate-point on the fan blade away from where the fan blade enters the hub body.

16. The apparatus of claim 1, wherein the hub body is comprised of a first metal material, and the fan blades are comprised of one of the first metal material or a second metal material, and the fan blades are spot welded to the hub body to reinforce the attachment of the fan blades within the plural blade retention apertures.

17. A fan apparatus comprising:

a hub comprising an annular hub body having an outer peripheral wall, an interior, a central axis, and a top surface, wherein the hub body defines plural blade retention slots spaced apart from one another around the hub body, the blade retention slots extending radially outward from the interior through to the outer peripheral wall and having top openings across at least part of the top surface of the hub body;

plural fan blades having respective base portions attached to respective blade portions, wherein the base portions are respectively removably disposed in the plural blade retention slots with the blade portions extending radially outwards from the outer peripheral wall, wherein the plural blade retention slots are angled, as defined by long central axes of the plural blade retention slots being oriented at one or more non-zero degree angles relative to a radius of the hub body, the radius extending perpendicularly between the central axis and the outer peripheral wall, and wherein the base portions are at least one of tapered or flared for engagement with complementary features of the hub body for the fan blades to be retained by the hub at least solely by centrifugal force when the hub is rotated for operation of the fan apparatus; and an end cap fastened to the hub body and configured to at least partially cover the top openings of the slots to prevent the fan blades from being longitudinally removed from the slots in a direction of the central axis.

18. The apparatus of claim 17, wherein the interior of the hub body is hollow and defined by an inner peripheral wall, the top surface interconnecting the outer peripheral wall and the inner peripheral wall, and wherein the blade retention slots are open across the top surface from the inner peripheral wall to the outer peripheral wall.

19. The apparatus of claim 18, wherein the slots are at least one of radially angled or longitudinally angled relative to the radius or the central axis of the hub body, respectively.

20. A vehicle comprising:

a heat exchanger; and the fan apparatus of claim 17 operably coupled to the heat exchanger;

wherein the fan apparatus is configured for each fan blade of the plural fan blades to be accessed for removal from the hub body in the direction of the central axis, when the end cap is removed, and without having to detach any others of the fan blades or any other fan blades of the vehicle.

* * * * *